United States Patent [19]

Schelling et al.

[11] Patent Number: 4,548,123

[45] Date of Patent: Oct. 22, 1985

[54] OSCILLATOR

[76] Inventors: Mario Schelling, Weidstrasse 629, 8913 Ottenbach; Bruno Schelling; Armin Schelling, both of Stationsstrasse 7, 8907 Wettswil, all of Switzerland

[21] Appl. No.: 344,055

[22] Filed: Jan. 29, 1982

[30] Foreign Application Priority Data

Feb. 6, 1981 [CH] Switzerland ..... 815/81

[51] Int. Cl.[4] ..... F15B 21/02

[52] U.S. Cl. ..... 91/39; 92/75; 92/142; 137/625.21

[58] Field of Search ..... 91/39, 40, 35, 352; 92/174, 75, 142; 137/625.21, 802, 596; 464/27

[56] References Cited

U.S. PATENT DOCUMENTS

| | | | |
|---|---|---|---|
| 2,564,220 | 8/1951 | Hamill | 92/142 |
| 3,204,858 | 9/1965 | Drus | 92/174 |
| 3,485,139 | 12/1969 | Sheesley | 92/72 |
| 3,702,143 | 11/1972 | Wagenen et al. | 137/625.21 |
| 3,810,417 | 5/1974 | Sieke . | |
| 3,851,669 | 12/1974 | Zellbeck et al. | 137/625.21 |
| 4,007,625 | 2/1977 | Houben et al. . | |
| 4,308,924 | 1/1982 | Boguth | 91/39 |
| 4,350,080 | 9/1982 | Page, Jr. | 91/39 |

FOREIGN PATENT DOCUMENTS

| | | |
|---|---|---|
| 524771 | 6/1972 | Switzerland . |
| 526724 | 8/1972 | Switzerland . |
| 577637 | 5/1976 | Switzerland . |

*Primary Examiner*—Robert E. Garrett
*Assistant Examiner*—Richard S. Meyer
*Attorney, Agent, or Firm*—Browdy and Neimark

[57] ABSTRACT

An oscillator is proposed which comprises a pair of cylinders having a common, circular-cylindrical outer wall (100) and two sealingly guided pistons (120, 122) each having one piston rod (121, 123), which are likewise guided in a sealing manner to the outside through the closure walls of the cylinder. The cylinder is divided by the pistons (120, 122) into outer chambers (124, 125) and inner chambers combined into one common chamber (126). The chamber (126) is filled with fluid. The outer chambers (124, 125) have two openings (102, 103) offset from one another by 180°. A control cylinder (101) having axially offset, oppositely disposed holes (104, 105, 106, 107) connects the outer chambers in alternation with an annular high-pressure chamber (113, 115) and an equalization chamber (114) whenever the control cylinder (101) is rotated. The two pistons (120, 122) thereby execute movements in common toward the left or right, respectively. The stroke is determined by the quantity of fluid capable of flowing out of the high-pressure chamber and into the equalization chamber, and the frequency is determined by the speed of rotation of the control cylinder. A direct control of an oscillator is thus realized, without additional connecting lines and the delay associated with such lines. Frequencies of up to 7000 Hz and strokes up to 10 mm can be generated.

7 Claims, 4 Drawing Figures

OSCILLATOR

FIELD OF THE INVENTION

The present invention relates to an oscillator having operating or working pistons, which are displaceably guided in positive-displacement work chambers, and a pressurized fluid as its working medium.

BACKGROUND OF THE INVENTION

Oscillators of this general type are known in the art. For example, U.S. Pat. No. 3,810,417 describes a method and an apparatus for adjusting a work piston in a cylinder. The work piston is made to vibrate by means of introducing and removing a pressure medium, and a control unit is located between the work cylinder and a reservoir for the pressure medium. There is a control cylinder in this control unit which has a control piston provided with axial grooves. The control piston is driven such that it is both axially displaceable and rotatable, so that a controlled quantity of the pressure medium can be sent in the desired direction at a given time. An apparatus of this kind, if it has a piston which is prestressed at one end, requires three lines for the pressure medium between the reservoir and the work cylinder, while with a cylinder that moves in both directions four lines are required. These lines must be sealed appropriately, and furthermore they cause not only a loss in power but a delay in the effect exerted on the work cylinder, so that the oscillation frequency can be increased up to an order of magnitude of 100 Hz.

In Swiss application No. 526,724, an apparatus for generating pneumatic rectangular oscillations is described, thus providing a further possible embodiment for a control unit such as may be used with the foregoing apparatus.

A fluidics oscillator is described in U.S. Pat. No. 4,007,625 which includes an oscillator crystal for the purpose of closing off one output of the oscillator. This oscillator crystal serves to pick up the oscillator frequency when determining the mixture ratio of a gas mixture.

SUMMARY OF THE INVENTION

No oscillator has been known until now which is capable of operating with a direct drive system, without any lines for a fluid and thus without the delay and power losses associated with such lines, and which is thus capable of executing mechanical oscillations up to several thousand Hz. This object will now be attained by the present invention, which provides positive-displacement work chambers which comprise at least one pair of cylinders, each divided by a work piston into an outer and an inner chamber. The work pistons are interconnected in a force-transmitting manner via the inner chambers, while the outer chambers provide a passageway for the piston rods and passages for the fluid. In alternation and periodically, fluid is supplied to one cylinder of the pair and removed from the other at the direction of a control means.

Various exemplary embodiments of the invention will now be described in detail, referring to the drawings.

DESCRIPTION OF THE PREFERRED EMBODIMENTS

Figure 1:
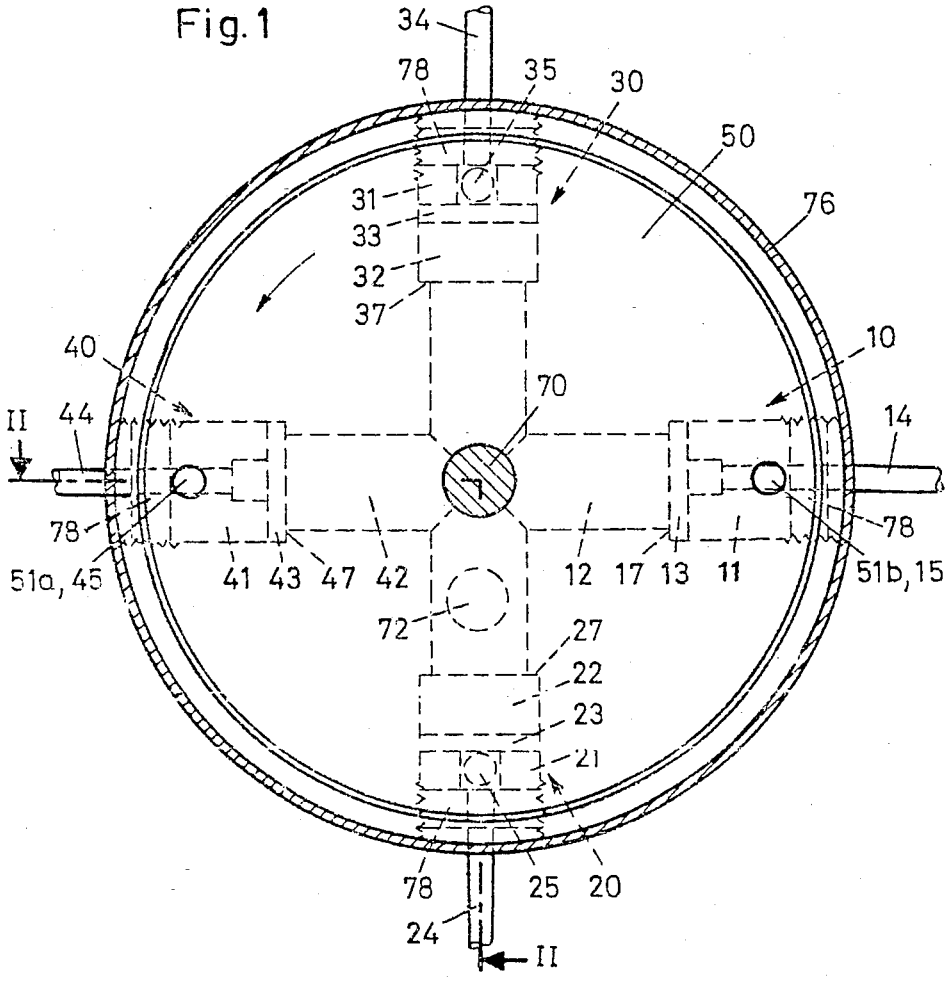
FIG. 1 is a sectional view in the form of an outline, taken along the line I—I of FIG. 2, for a first exemplary embodiment of the invention.

Four cylinders 10, 20, 30, 40 disposed at right angles to one another are located within a circular cylinder body 1. Each cylinder has a shoulder 17, 27, 37, 47, and in the portion of the cylinder having the greater diameter there is one piston 13, 23, 33, 43, each having a piston rod 14, 24, 34, 44, which are guided to the outside, being sealed by a sealing cap 78 threaded into the cylinder body 1 and having a sealing disc 80 and a tensioning spring 82. The piston 13, 23, 33, 43 divides the respective cylinders 10, 20, 30, 40 into an outer chamber 11, 21, 31, 41 and an inner chamber 12, 22, 32, 42. The four inner chambers communicate with one another.

The outer surfaces of the cylinder body 1, which are parallel to the plane containing the four axes of the cylinders, are embodied as flat, and openings 15, 25, 35, 45 are drilled upward and openings 16, 26, 36, 46 are drilled downward through the outer surfaces, leading from the outer chambers 11, 21, 31, 41. Discs 50 and 60 having holes 51 and 61 rest on the outer surfaces. The two discs 50 and 60 are rigidly interconnected by means of a shaft 70 passing through the point of intersection of the cylinder axes. A housing 76 encloses the entire cylinder body 1 forming, with the two discs 50 and 60, an upper pressure chamber 90 and a lower equalization chamber 92. The pressure chamber 90 communicates via a connection 74 with a high-pressure reservoir for fluid under pressure, and the equalization chamber 92 communicates via a connection 72 with a low-pressure reservoir. The inner chambers 12, 22, 32, 42 are filled with fluid.

The mode of operation of the apparatus will now be explained, with the aid of FIG. 3.

Figure 3:
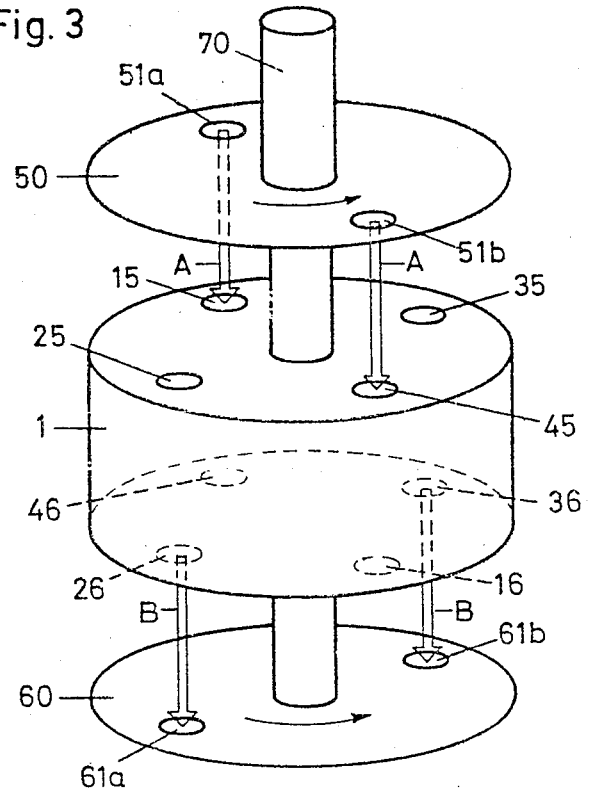
FIG. 3 is a schematic, exploded view of the apparatus shown in FIGS. 1 and 2.

The discs 50 and 60, as shown in FIG. 3, each have two bores 51*a*, 51*b* and 61*a*, 61*b*. If the discs 50, 60 are rotated together, then these bores are located above openings in the outer chambers of cylinders disposed opposite one another. As seen in FIG. 3, the bores 51*a*, 51*b* are located above the openings 15, 45, while the bores 61*a*, 61*b* are located above the openings 26, 36.

Fluid under pressure thus flows as indicated by the arrows A out of the high-pressure chamber 90, through the bores 51*a*, 51*b* and the openings 15, 45, and into the outer chambers 11, 41, and the pistons 13, 43 are pressed into the position shown in FIG. 1. Because the bores 61*a*, 61*b* in the disc 60 and the openings 26, 36 are in alignment with one another, the fluid is capable of flowing out of the outer chambers 21, 31 into the equalization chamber 92, so that the pistons 23, 33 are capable of moving under pressure, along with the fluid in the inner chambers 12, 22, 32, 42, into the outer position also shown in FIG. 1.

If the discs 50, 60 are rotated further, then the same process occurs with the adjacent cylinders. The piston rods 14, 44 and 24, 34 thus execute movements in the same direction in a paired manner, the amplitude of these movements being dependent on the quantity of fluid supplied and their frequency being dependent on the rotational speed of the disc.

This demonstrates that an oscillating drive can be brought about using only a force for rotating the discs and a force for generating the pressure in the fluid, and that no additional control unit with an additional three to four lines is required. In a test model, it was possible to generate oscillations with an amplitude up to 10 mm and with frequencies up to 7000 Hz, with a fluid pressure of from 1 to 2 bar being sufficient.

Figure 4:
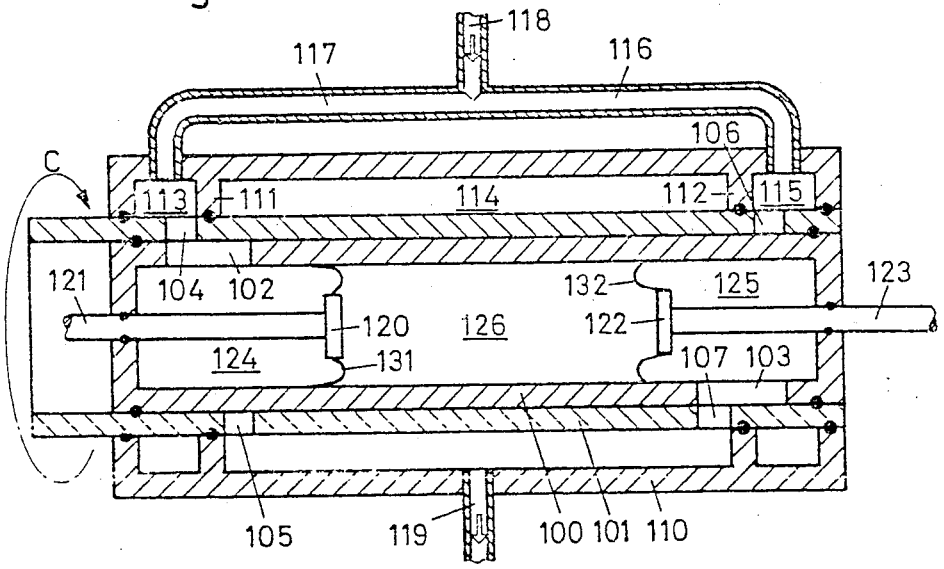
FIG. 4 is a sectional view taken through a pair of cylinders of a second exemplary embodiment of the invention.

FIG. 4 shows a different exemplary embodiment, in which the cylinder pair 100 is embodied with a common axis and a circular jacket cross section. The cylinder pair 100 is enclosed by a control cylinder 101, which is connected with a drive means indicated by the arrow C. The cylinder pair 100 has openings 102, 103. These openings 102, 103 are embodied as elongated in the direction of the jacket lines, and the longitudinal axes are located in a common plane passing through the cylinder axis and in different cylinder halves.

The control cylinder 101 is provided with four holes 104, 105, 106, 107, whose axes again are disposed in a common plane passing through the axis of the control cylinder 101. These holes are disposed in pairs, offset relative to one another, such that they are aligned in alternation first with an outer portion of the openings 102, 103 and then with an inner portion of these openings.

The control cylinder 101 is encompassed by a housing 110, which is likewise cylindrical. The housing 110 has two annular ribs 111, 112, forming three annular chambers 113, 114, 115 between the control cylinder 101 and the housing 110. The two outer annular chambers 113, 115 communicate via lines 116, 117, 118 with a source of fluid under pressure and thus acts as the high-pressure chamber in the exemplary embodiment described earlier. The middle annular chamber 114 communicates via an outlet 119 with the low-pressure side of the fluid source and thus embodies the equalization chamber as described for the first exemplary embodiment.

The holes 104, 105, 106, 107 are disposed in a distributed manner such that the outer chamber 124 of the first cylinder, subdivided by a piston 120, communicates via the opening 102 and the hole 104 with the high-pressure chamber 113, and the outer chamber 125 of the other cylinder, subdivided by a piston 122, communicates via the openings 103 and the hole 107 with the equalization chamber 114.

Naturally, the two inner chambers of the cylinders which are combined into one common chamber 126 are filled with fluid in this second embodiment as well, so that in the phase illustrated in the drawings this arrangement causes a movement of the two pistons 102, 122—and thus the two piston rods 121, 123 as well—toward the right as seen in the drawing.

If the control cylinder 101 is rotated by 180° in the direction of the arrow C, the high-pressure chamber 115 communicates via the hole 106 and the opening 103 with the outer chamber 125, and the equalization chamber 103 communicates via the hole 105 and the opening 102 with the outer chamber 124. The two pistons 120, 122 and the piston rods 121, 123 accordingly execute a movement in the opposite direction, toward the left as seen in the drawing. The result, in this exemplary embodiment as well, is a rotational movement of the control means, that is, of the control piston 101, and a translating movement of the piston rods; here, again, the stroke is determined by the quantity of the fluid flowing in and out and the frequency is determined by the rotational speed.

Figure 2:
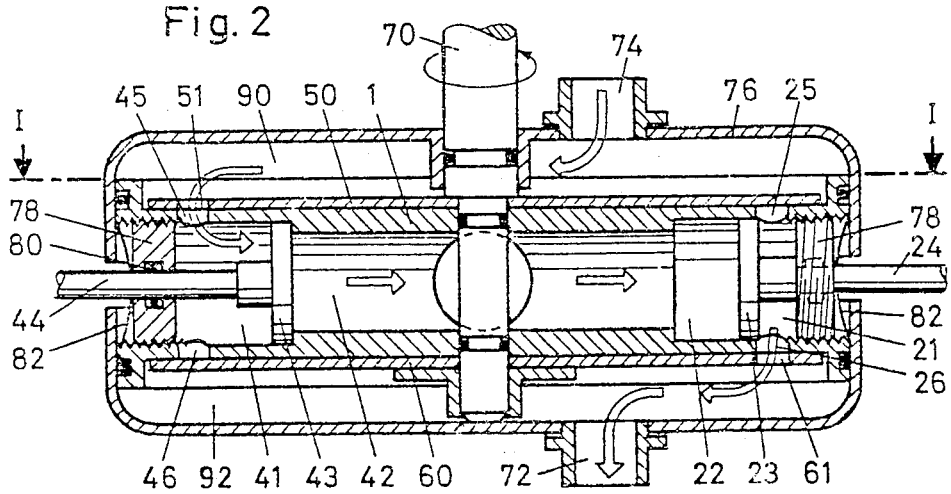
FIG. 2 is a sectional view of one pair of cylinders, taken along the line II—II of FIG. 1.

Naturally it is also possible for more holes to be provided in the two exemplary embodiments, that is, more holes in the discs 50, 60 of FIGS. 1–3 or more holes in the control cylinder 101, in order to attain a higher frequency at a lower rotational speed. The pistons 120, 122 in the exemplary embodiment of FIG. 4 are connected in a sealing manner with the cylinder wall by means of a soft diaphragm 131, 132. The stroke of the pistons 120, 122 is thus limited by the dimensions of these diaphragms.

It will be appreciated that various changes and modifications may be made without departing from the scope of the invention as defined by the appended claims.

What is claimed is:

1. A high frequency oscillator having a housing, work pistons displaceably guided within positive-displacement chambers disposed within said housing, and having a pressurized fluid for a working medium, characterized in that the positive-displacement work chambers comprise two pairs of cylinders, each cylinder being divided by a respective one of said work pistons into an outer and an inner chamber, said two pairs of cylinders being disposed in the shape of a cross with the cylinder axes of said four cylinders being located in a common plane, the work pistons of opposing cylinders communicating in a force-transmitting manner via the inner chambers, each of the outer chambers having an axial passageway for a sealingly guided piston rod and openings for the passage therethrough of the fluid, and rotating control means for alternately and periodically supplying said fluid to one pair of the cylinders and removing it from the other pair of said cylinders, said cylindrical walls of said outer chambers defining two spaced planes parallel to the common plane of the cylinder axes, the openings for fluid supply being disposed in one of said two planes and the openings for fluid removal being disposed in the other of said two planes, and said control means comprising two rotatable discs rigidly connected with one another, each one of said discs being disposed in a sealed manner in a respective one of each of the said two planes, said discs being provided with holes which can be aligned with said openings, whereby the frequency of movement of said pistons within said cylinders is controlled solely in response to the rotational speed of said control means.

2. An oscillator as defined by claim 1, characterized in that the holes in each disc are diametrically opposed, the holes in one disc being disposed 90° relative to the holes in the other disc.

3. An oscillator as defined in claim 2, characterized in that the two discs are connected with one another by means of a shaft passing through the center of the cylinder pairs.

4. An oscillator as defined by claim 3, characterized in that the said surfaces of the cylinder walls of the outer chambers and the discs are disposed relative to one another such that one surface and one disc are in one fluid chamber and the other surface and disc are in another fluid chamber.

5. An oscillator as defined by claim 1, characterized in that the longitudinal axes of opposed pairs of cylinders from straight lines, and the cylinder walls of the outer chambers form a circular cylinder.

6. An oscillator as defined by claim 1, characterized in that the force-transmitting connection of the opposing pairs of pistons is effected by means of a hydraulic fluid.

7. An oscillator having at least one pair of fluid-coupled work pistons capable of executing oscillations with a frequency of up to several thousand Hz, comprising:

a housing containing two pairs of opposing cylinders, each cylinder being divided by a work piston into an inner chamber and an outer chamber, said work pistons communicating with each other in a force-transmitting manner via said inner chambers;

a fluid source comprising a pressurized fluid inlet chamber disposed on one side of said housing, and a pressurized fluid outlet chamber disposed on an opposing side of said housing;

first and second rotating means, disposed respectively on said one side and said opposing side of said housing, for controlling passage of said fluid from said inlet chamber through said housing to said outlet chamber, said controlling means including means for communicating said inlet chamber with one of said outer chambers of said one pair of cylinders and said second controlling means including means for communicating the outer of said outer chambers of said one pair of cylinders with said outlet chamber;

said first and second controlling means acting simultaneously to move said pistons of opposing cylinders at the same time and in the same direction; and the frequency of movement of said pistons within said cylinders being controlled solely as a function of the rotational speed of said first and second control means.

* * * * *